US011052277B2

(12) United States Patent
Harms

(10) Patent No.: US 11,052,277 B2
(45) Date of Patent: Jul. 6, 2021

(54) WEIGHT SELECTION WITH ALIGNMENT INDICIA

(71) Applicant: Michael Harms, Chadds Ford, PA (US)

(72) Inventor: Michael Harms, Chadds Ford, PA (US)

( * ) Notice: Subject to any disclaimer, the term of this patent is extended or adjusted under 35 U.S.C. 154(b) by 0 days.

(21) Appl. No.: 16/056,788

(22) Filed: Aug. 7, 2018

(65) Prior Publication Data

US 2020/0047020 A1 Feb. 13, 2020

(51) Int. Cl.
*A63B 21/075* (2006.01)
*A63B 21/072* (2006.01)
*A63B 71/06* (2006.01)

(52) U.S. Cl.
CPC ..... *A63B 21/075* (2013.01); *A63B 21/0724* (2013.01); *A63B 2071/0694* (2013.01); *A63B 2244/09* (2013.01)

(58) Field of Classification Search
CPC ..... A63B 21/075; A63B 21/072–0728; A63B 21/0601; A63B 21/0602; A63B 21/0603; A63B 2071/0694; A63B 2071/065; A63B 2244/09; A63B 2220/52; A63B 71/06; A63B 71/0669
See application file for complete search history.

(56) References Cited

U.S. PATENT DOCUMENTS 4,043,553 A * 8/1977 Suarez ..... A63B 21/0608 482/110
4,089,528 A * 5/1978 Green ..... A63B 21/0602 441/35
5,445,587 A * 8/1995 Brown ..... A63B 21/0602 482/108
5,620,112 A * 4/1997 Brown ..... A63B 21/075 220/703
6,099,441 A * 8/2000 Bonnet ..... A63B 21/072 482/106
6,261,022 B1 * 7/2001 Dalebout ..... A63B 21/0728 482/107
7,182,716 B1 * 2/2007 Dawson ..... A63B 21/072 482/104
7,300,390 B1 * 11/2007 Krull ..... A63B 21/0728 482/107
7,621,855 B1 * 11/2009 Krull ..... A63B 21/075 482/107
8,007,416 B2 * 8/2011 Arlie ..... A63B 21/0605 482/108

(Continued)

OTHER PUBLICATIONS

Amazon.com listing entitled "Troy Weighted Bar ADVANCED Set—15lb, 18lb, 22lb, 27lb", 3 pages, first available Jun. 2, 2016 by seller "Troy". Retrieved from the Internet: https://www.amazon.com/Troy-Weighted-Bar-ADVANCED-Set/dp/B01GIP459M (Year: 2016).*

*Primary Examiner* — Megan Anderson
*Assistant Examiner* — Kathleen Vermillera

(57) ABSTRACT

A weightlifting apparatus has at least one indicia on at least one weight plate indicating the amount of weight of the weight plate. The barbell of the weightlifting apparatus can have alignment indicia on an outer surface thereon. The weightlifting apparatus is configured to selectively display the amount of weight on the weightlifting apparatus. The alignment indicia of the barbell is aligned with the at least one indicia on the weight plate to mark or indicate which indicia of a plurality of indicia is the selected indicia to be viewed.

8 Claims, 5 Drawing Sheets

(56) References Cited

U.S. PATENT DOCUMENTS

| | | | | |
|---|---|---|---|---|
| 2007/0197352 | A1* | 8/2007 | Charniga | A63B 21/06 482/93 |
| 2011/0319233 | A1* | 12/2011 | Ross | A63B 21/075 482/93 |

* cited by examiner

WEIGHT SELECTION WITH ALIGNMENT INDICIA

FIELD OF THE INVENTION

The present invention relates generally to weightlifting, free weights and barbell devices used therein and more particularly, to weight selection and weight alignment methods and apparatus.

BACKGROUND OF THE INVENTION

Barbells used in the sport of weight lifting are provided with disc-shaped weights or circular weight plates that can be mounted alone or in combination on the end of a member, such as a barbell, to allow the user to vary the weight he or she lifts during the workout. These weight plates have holes through their centers to allow a bar to be inserted through the discs. Various types of collars can be placed on the bar between the outermost weight disc and the end of the bar, to secure the weight discs on the bar.

During the practice of weight lifting, a user will change the weight plates in order to increase or decrease the amount of weight on the barbell. Since weight plates come in a variety of shapes and weight, it can be difficult to know exactly how much weight is on the barbell. It would be desirable to know exactly how much weight is on each side of the barbell or how much combined weight is on the barbell so the user knows how much to add or subtract to find the ideal weight for the workout. Knowing the weight on the barbell with little to no effort (such as a quick visual inspection) allows the weight lifter to vary the load on the barbell with minimum interruption of time and/or interruption in the weightlifter's mental concentration.

SUMMARY OF THE INVENTION

An aspect of the present invention is to engage weight plates on opposite distal ends of a barbell. Each weight plate has at least one indicia on an outer edge or surface of the weight plate. A weightlifter can rotate the weight plates on the bar bell so that the indicia is visible to the weightlifter. As more weights are added to the barbell, the weightlifter can rotate each weight plate accordingly to align indicia of at least one weight plate with another at least one weight plate to show the combined weight of the weight plates or the combined weight of the weight plates and the barbell.

Additional features and advantages of the present invention will become apparent to those skilled in the art from the more detailed description that follows.

BRIEF DESCRIPTION OF THE FIGURES OF THE DRAWING

With reference to the Figures of the Drawing, wherein like numerals represent like parts and assemblies throughout the several views.

DETAILED DESCRIPTION OF THE PREFERRED EMBODIMENT

Figure 1A:
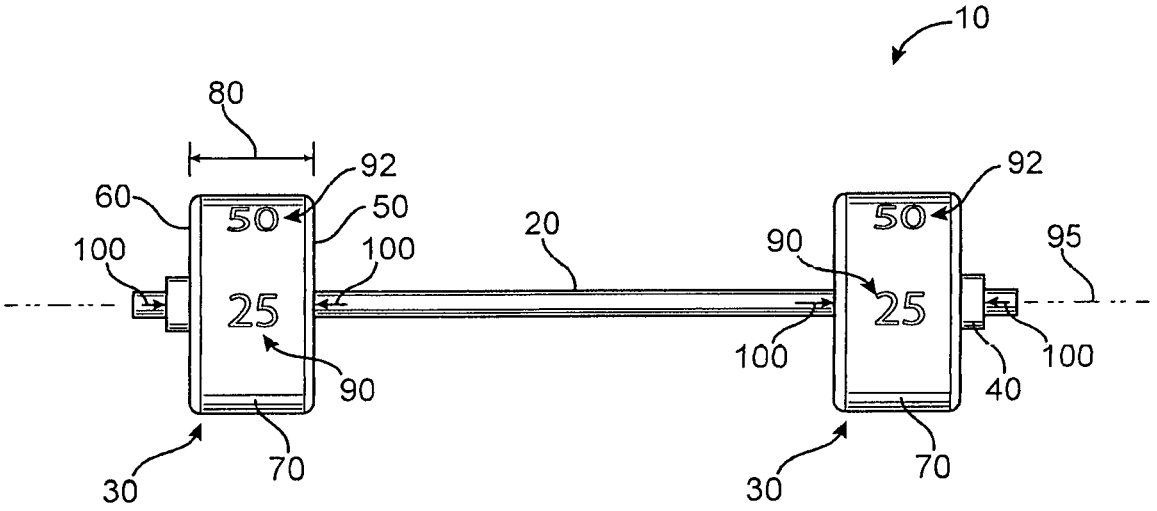
FIGS. 1A-D are front views of several embodiments of a barbell having a plurality of weight plates with indicia according to the principles of the present invention.

FIGS. 1A-D are front views of several embodiments of a weight training apparatus 10 of the present invention. Weight training apparatus 10 includes an elongate member, such as a barbell 20, a pair of weight members 30 (such as plates, discs or any other shape) rotatably mounted on opposite ends of barbell 20 and collar members 40 which can be used to secure each weight plate 30 onto the barbell 20. Each weight plate 30 has a first side 50 and a second side 60. Each weight plate has an outer edge or surface 70 extending between the first side 50 and second side 60. The width of outer surface 70 is indicated by arrow 80. Depending on the amount of weight of each respective weight plate, the width of outer surface 70 could change. For example, the outer surface 70 of a 15 lb weight plate will have a smaller width 80 than the width 80 of the outer surface 70 of a 45 lb weight plate.

As shown in FIG. 1*a*, each respective weight plate 30 has a first indicia 90 on outer surface 70. In this embodiment, 25 lb weight plates 30 are disposed on opposite distal ends of the barbell 20. First indicia 90, in this case, is the number "25" indicating that each weight plate is 25 lb. However, first indicia 90 can be any marking, language, numbers, symbols, letters or in any combination thereof, and further, first indicia 90 can be in any order, sequence, color or pattern. Each first indicia 90, or in this case, the number "25", is aligned with each other along a centerline 95 of barbell 20. Thus, a weightlifter knows that each weight plate 30 weighs 25 lb and that the combined weight of weight plates 30 is 50 lb (e.g. 25+25=50).

In an optional embodiment, barbell 20 has at least one alignment indicia 100 on an outer surface thereof. Alignment indicia 100 is a marker to help the weightlifter when he or she is aligning first indicia 90 of one weight plate 30 with the other first indicia 90 of the other weight plate 30. Alignment indicia 100 can be any marking, language, number, symbol (such as an arrow as shown in FIG. 1A), letter or in any combination thereof, and further, alignment indicia 100 can be in any order, sequence, series, color or pattern. In addition, alignment indicia 100 can extend along the entire length of barbell 20, or alignment indicia 100 can extend substantially the length of barbell 20, or alignment indicia 100 can extend only a portion of the length of barbell 20.

Figure 1B:
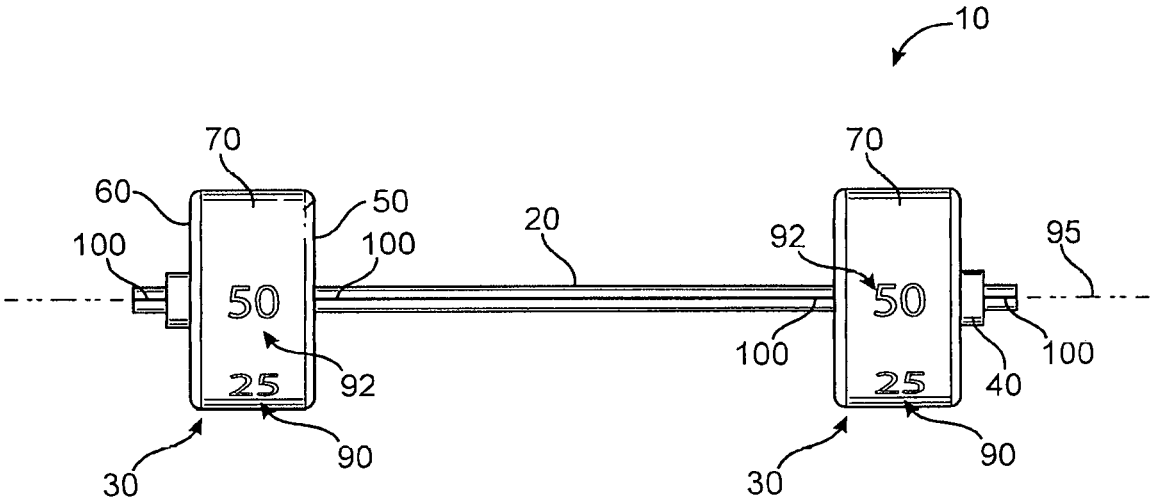

As shown in FIG. 1A, weight plate 30 has a second indicia 92 spaced apart from first indicia 90. Second indicia 92 is also disposed on outer surface 70. In this embodiment, first indicia 90 communicates or indicates different information (such as the weight of the respective weight plate 30) than second indicia 92, as will be explained more below. In the example of FIGS. 1A-B, the second indicia 92 is the number "50". Thus, another option and as shown in FIG. 1B, the weightlifter can rotate the same weight plates 30 of FIG. 1A so that second indicia 92 (the number "50") of each of the weight plates is aligned with each other along centerline 95 or aligned along alignment indicia 100 of barbell 20. In this embodiment, the weightlifter knows the combined weight of both weight plates 30 is 50 lb (e.g. 25+25=50).

Figure 1C:
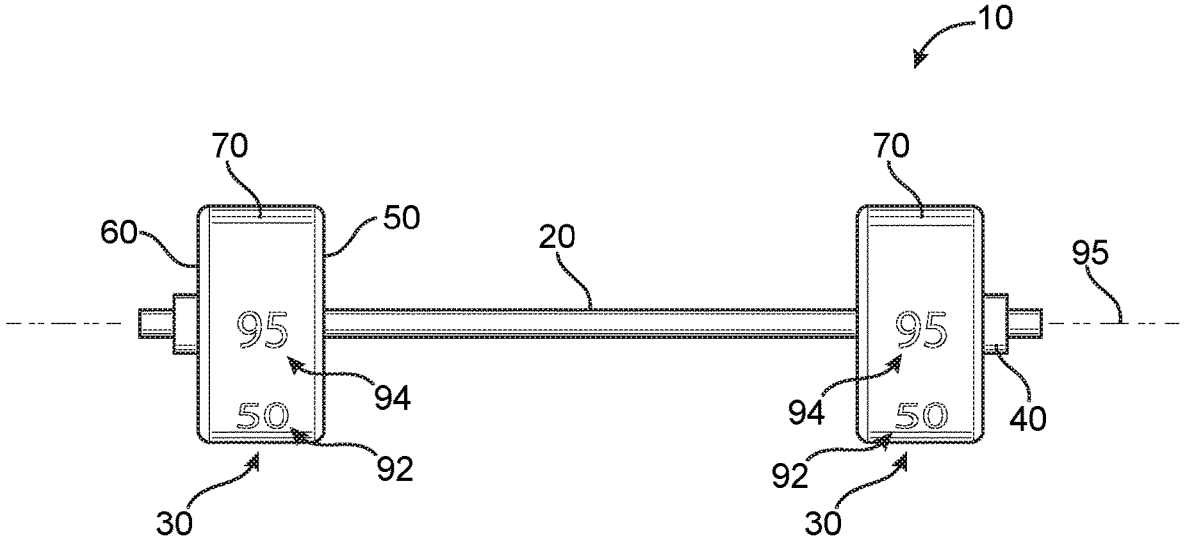
Figure 1D:
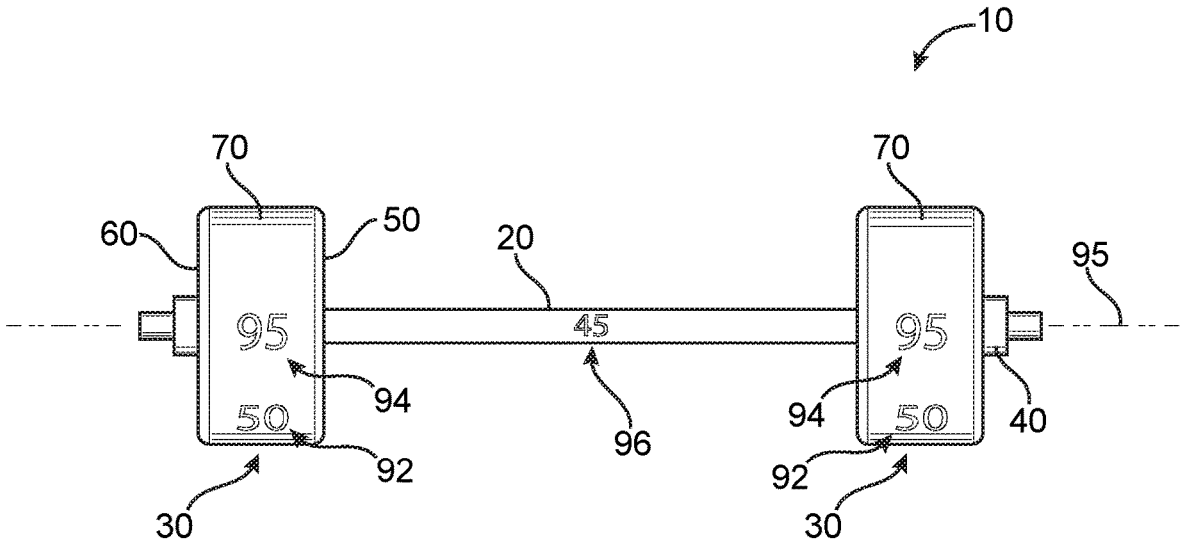

As yet another option and as shown in FIG. 1C, the weightlifter can rotate the same weight plates 30 of FIGS. 1A-B so that a third indicia 94 (the number "95") of each of the weight plates is aligned with each other along centerline 95 or aligned along alignment indicia 100 of barbell 20. In this example of FIG. 1C, the weightlifter would know that the number "95" represents the weight of the two weight plates 30 (25 lb+251b) plus the weight of the barbell 20 (which in this example is 45 lb) bringing the total weight to equal 95 lb. In an optional embodiment and as shown in FIG. 1D, barbell 20 has indicia 96 (which in this example is the number 45 to indicate 45 lb) on an outer surface of barbell 20 to display the amount of weight of barbell 20. Although indicia 96 is shown in a central region of barbell 20, indicia 96 on barbell 20 could be anywhere on the outer surface of barbell 20. In the embodiment of FIG. 1D, the weight plates still display the number 95 to represent the combined weight of weight plates 30 (25 lbs. each) and barbell 20 (which weights 45 lbs.). However, the weightlifter is not limited to the described configuration of weight plates 30 of FIG. 1D and the weightlifter can choose to rotate weight plates 30 to any of the configurations described herein. For example, as shown in FIG. 1D, the weightlifter could choose to show the number "50" on each of the weight plates 30 and also show the number "45" on the barbell. Thus, the weightlifter would have chosen to represent that the weight training apparatus has 50 lb of weight plates and a 45 lb barbell.

Figure 2:
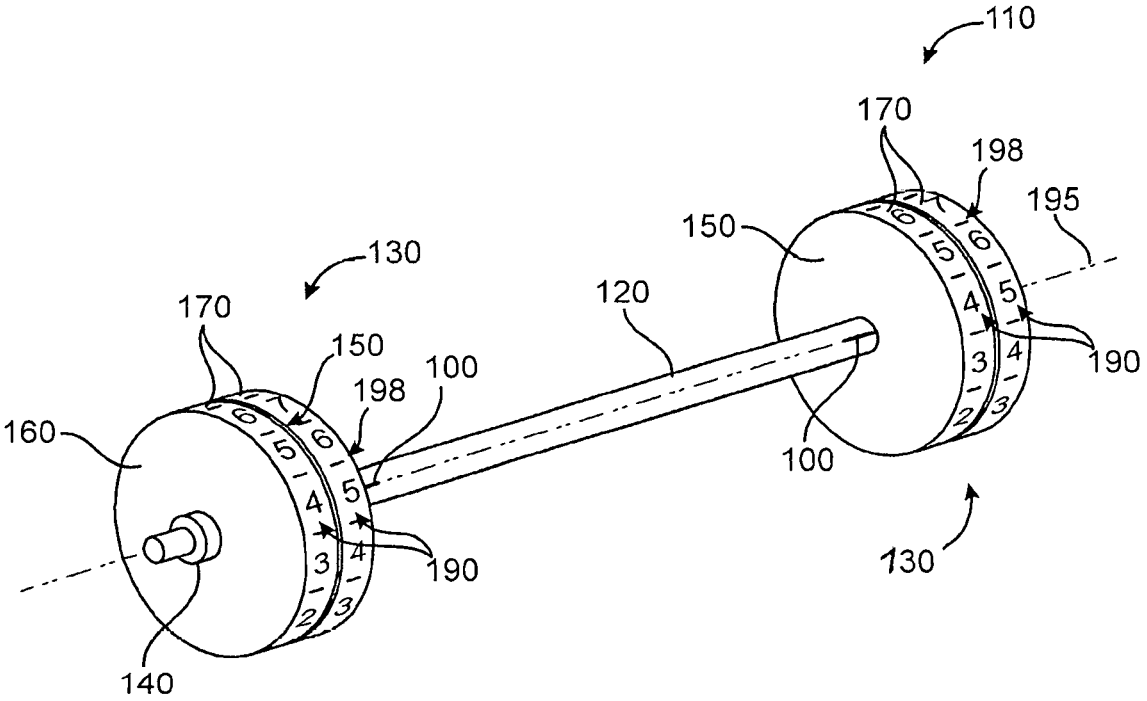
FIG. 2 is a perspective view of an embodiment of a barbell having a plurality of weight plates with indicia according to the principles of the present invention.

FIG. 2 is another embodiment of a weight training apparatus 110. Weight training apparatus 110 includes a barbell 120, a plurality of weight plates 130 disposed on opposite sides of barbell 120 and collar members 140 which are used to secure the plurality of weight plates 130 onto barbell 120. As described in the embodiment of FIG. 1, each weight plate 130 has a first side 150 and a second side 160 with an outer surface 170 spaced between the first and second sides 150, 160. At least one weight plate 130 in the plurality of weight plates has at least one indicia 190 on outer surface 170 of each weight plate 130. As shown in FIG. 2, each weight plate 130 has a plurality of indicia on outer surface 170. In this embodiment, indicia 190 is a series of numbers on outer surface 170. In one example, which will be described in greater detail below, indicia 190 is a series of numbers of "0", "1", "2", "3", "4", "5", "6", "7", "8" and "9". However, indicia 190 can be any marking, language, number, symbol, letter or in any combination thereof, and further indicia 190 can be in any order, sequence, series, or pattern.

The plurality of weight plates 130 with indicia 190 on outer surfaces 170 allows a weightlifter to rotate each respective weight plate in order to arrange indicia 190 in such a way as to communicate the amount of weight (or any message depending on the indicia) on weight training apparatus 110. One way to communicate the amount of weight is to align the indicia 190 along a centerline 195 of barbell 120 such that the indicia 190 is visible to the weightlifter or an observer. As shown in FIG. 2, indicia 190 of each weight plates 130 shows the number "45" on each of the respective pairs of weight plates 130. Specifically, the number "4" of one plate and the number "5" on the adjacent plate are aligned together along centerline 195 to display the number "45" or aligned along alignment indicia 100 of barbell 120. To achieve alignment, weight plates 130 can optionally have alignment indicia 198 to help align a plurality of weight plates with each other along centerline 195 or aligned along alignment indicia 100 of barbell 120. In one embodiment, alignment indicia 198 are horizontal lines spaced between indicia 190 to help separate each respective indicia 190. Alignment indicia 198 of one weight plate is aligned with alignment indicia 198 of an adjacent weight plate. Thus, a weightlifter would align alignment indicia 198 of each weight plate in order to align the respective indicia 190 of one weight plate 130 with another adjacent weight plate 130 or a plurality of adjacent weight plates 130. Although alignment indicia 198 is shown to be a horizontal line, alignment indicia 198 can be any marking, language, number, symbol, letters or in any combination thereof, and further alignment indicia 198 can be in any order, sequence, series or pattern on the outer surface 170 of weigh plate 130.

Figure 3A:
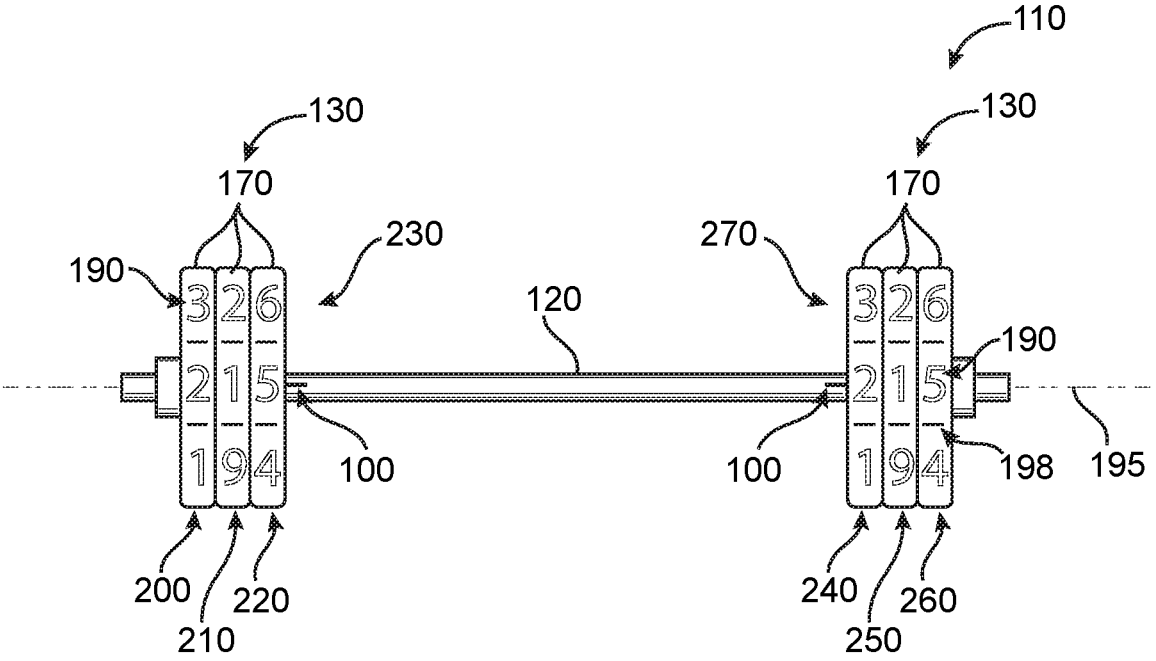
FIGS. 3A-B are front views of several embodiments of a barbell having a plurality of weight plates with indicia according to the principles of the present invention.
Figure 3B:
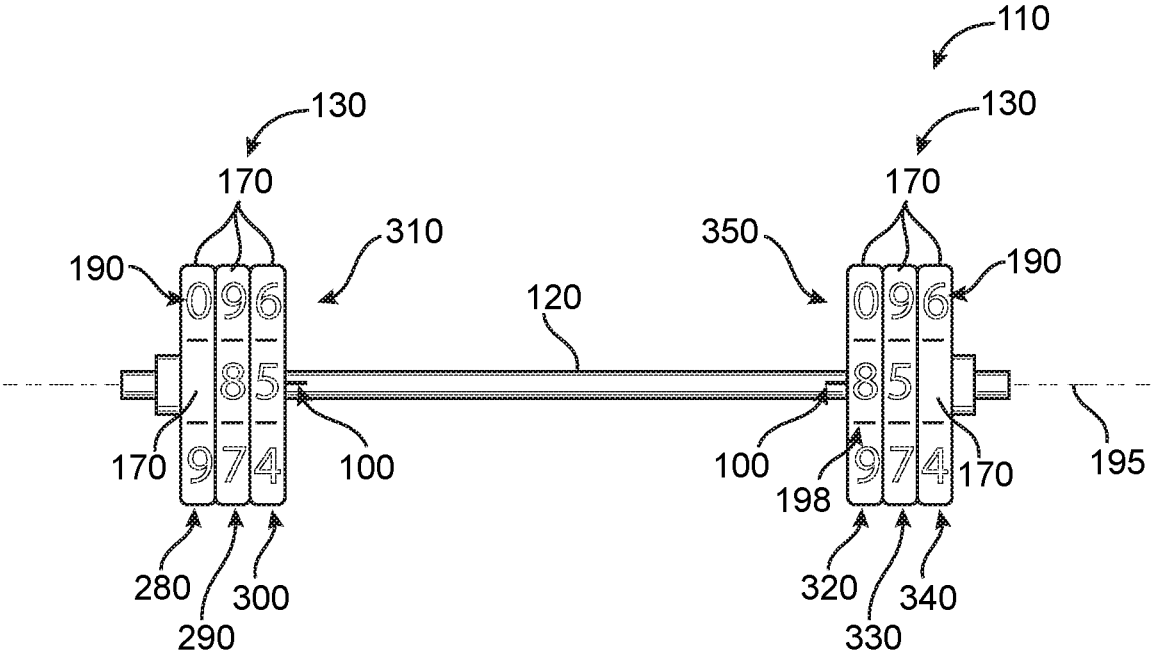

As shown in FIGS. 3A-3B, a weightlifter can choose how to display the total weight of the barbell 120 and weight plates 130. For example, in FIG. 3A, the weightlifter can display the combined total weight of all the weight plates 130 on the barbell 120 (and optionally also include the weight of the barbell 120). For example, in FIG. 3A, the weightlifter has three weight plates 200, 210 and 220 on one side 230 of the barbell 120 and three weight plates 240, 250 and 260 on an opposite side 270 of barbell 120. Weight plate 200 weighs 15 lb, weight plate 210 weighs 25 lb and weight plate 220 weighs 45 lb, which is a total weight of 85 lb. Similarly, plate 260 weighs 15 lb, weight plate 250 weighs 25 lb and weight plate 240 weighs 45 lb, which is a total weight of 85 lb. Thus, each side 230 and 270 of barbell 120 has a total weight of 170 lb. The weightlifter has chosen to display 215 lb (as shown in FIG. 3A), which includes the weight of the barbell 120 (which in this example is 45 lb), or, in other words 170 lb+45 lb equals 215 lbs. In an alternative example (not shown in FIG. 3A), the weightlifter could have chosen to display the number "170" on each of the side 230 and 270 of the barbell 120 to represent the total weight of only the weight plates 130 (in other words, each weight plate 130 pair weighs 85 lb).

In the example of FIG. 3A, the weightlifter has decided to display 215 lb in order to represent the total weight to be lifted (total weight is the weight plates plus the barbell). In order to display the total weight and for the weightlifter to remember the exact weight on weight training apparatus 110, the weightlifter rotates weight plate 200 so that the number "2" is visible (to either the weightlifter or to a bystander). The weightlifter then rotates weight plate 210 so that the number "1" is visible and in alignment with the number "2" of weight plate 200. The weightlifter next rotates weight plate 220 so that the number "5" is visible and in alignment with both the number "2" of weight plate 200 and the number "1" of weight plate 210. Thus, when these numbers are in alignment, the number 215 is visible across all the individual weight plates of 200, 210 and 220. Similarly, three weight plates 240, 250 and 260 on an opposite side 270 of the barbell 120 can be each rotated on barbell 120 such that weight plates 240, 250 and 260 are in alignment to display the total weight of 215 lbs. However, on side 270, weight plate 240 displays the number "2", weight plate 250 displays the number "1" and weight plate 260 displays the number "5".

As an alternative, the weightlifter can display the weight total of each group of plurality of weight plates 130 on each side of the barbell (as shown in FIG. 3B). In the example of FIG. 3B, the weightlifter has decided to display only the weight of each respective side of the barbell 120 and has chosen not to include the weight of the barbell 120. Three weight plates 280, 290 and 300 totaling 85 lb are one side 310 of barbell 120 and three weight plates 320, 330 and 340 totaling 85 lb are on an opposite side 350 of barbell 120. In the example of FIG. 3*a*, the number 215 needed to be displayed, thus, one number for each weight plate. However, in the example of FIG. 3B, not every weight plate needs to display indicia 190 or in this case a number. The total weight of 85 lbs. needs only two weight plates to display this number or in other words, one number for each weight plate. The weightlifter rotates weight plate 280 so that a portion of outer surface 170 with no indicia 190 is visible (to either the weightlifter or to a bystander). The weightlifter then rotates weight plate 290 so that the number "8" is visible and in alignment (along centerline 195) with the portion of weight plate 280 which has no indicia 190. The weightlifter next rotates weight plate 300 so that the number "5" is visible and in alignment with both the portion of weight plate 280 which has no indicia 190 and in alignment with the number "8" of weight plate 290. Thus, when weight plate 280 has no visible indicia 190 in alignment with the number "8" of weight plate 290 and the number "5" of weight plate 300, the number "85" is visible across the individual weight plates of 280, 290 and 300. Similarly, three weight plates 320, 330 and 340 (also totaling 85 lbs.) on an opposite side 350 of the barbell 120 can be each rotated on barbell 120 such that weight plates 320, 330 and 340 are in alignment to display the total weight of 85 lbs. However, on side 350, weight plate 320 displays the number "8", weight plate 330 displays the number "5" and weight plate 340 is rotated so that no number (or no indicia 190) is visible and that no number (or no indicia 190) is in alignment with the number "8" of weight plate 320 and the number "5" of weight plate 350. The above description of FIG. 3B is not limited to weight plates 280 and 340 having no indicia. For example, the number "85" can be displayed across any two adjacent weight plates 130, such as weight plates 280 and 290 or weight plates 330 and 340.

Figure 4A:
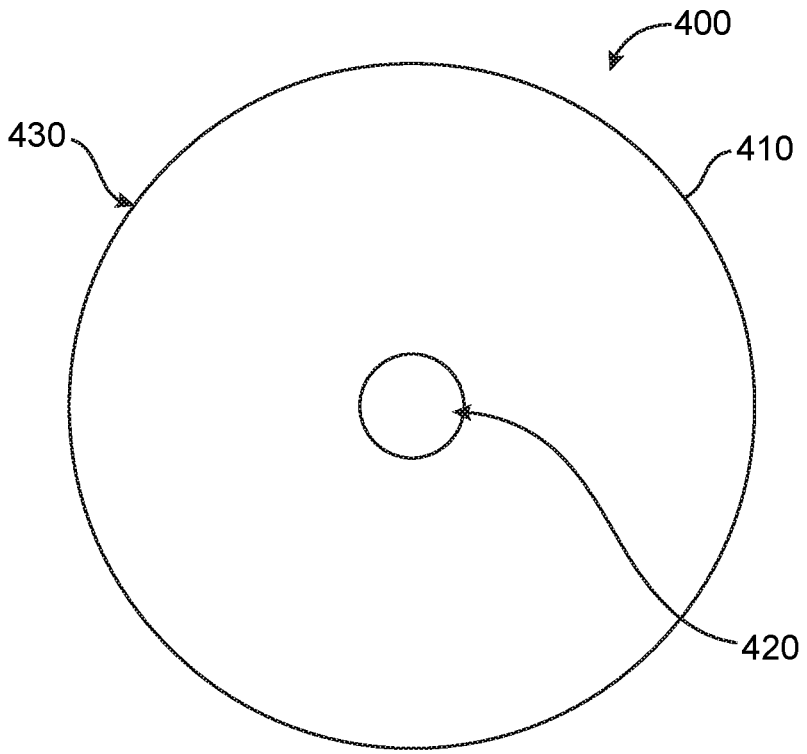
FIG. 4A is a side view of an exemplary weight plate without a barbell.
Figures 4B, 4C, 4D, 4E:
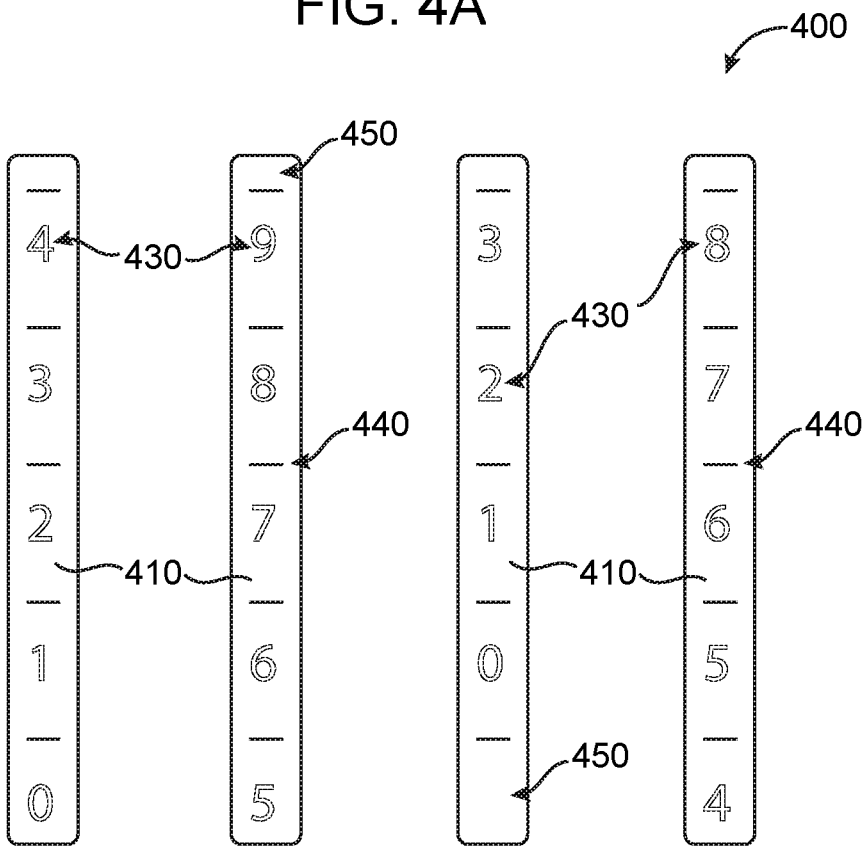
FIG. 4B is a front view of an exemplary weight plate without a barbell showing exemplary indicia on an outer surface of the weight plate.
FIG. 4C is an alternative front view of the exemplary weight plate of FIG. 4B.
FIG. 4D is an alternative front view of the exemplary weight plate of FIG. 4B.
FIG. 4E is an alternative front view of the exemplary weight plate of FIG. 4B.

FIG. 4 is a side view of an exemplary weight plate 400 having an outer surface 410 and a void 420 to receive a barbell (not shown). Indicia 430 is disposed on outer surface 410 but is not shown in the side view of FIG. 4A. FIGS. 4B-E show the same exemplary weight plate 400 of FIG. 4A having the same indicia 430 but shows weight plate 400 in different views. In the examples of FIGS. 4B-E, indicia 430 are a sequence of numbers, such as, for example, "0", "1", "2", "3", "4", "5", "6", "7", "8" and "9". In this example, the sequence of numbers are spaced apart and optionally have alignment indicia 440 between indicia 430. As described above, indicia 430 or alignment indicia 440 can be any marking, language, number, symbol, letter or in any combination thereof, and further indicia 430 or alignment indicia 440 can be in any order, sequence, series, color or pattern. In the example shown in FIGS. 4B-E and as described above in FIG. 3B, outer surface 410 may have a portion which does not have indicia 430. In the example shown in FIGS. 4*b-e*, a portion 450 of outer surface 410 does not have indicia 430 between the numbers "9" and "0". In the embodiment of FIGS. 4A-E, indicia is equally spaced apart and extend around the entire circumference of outer surface 410. In other embodiments, indicia 430 extends substantially around the circumference of outer surface 410. In yet another embodiment, indicia 430 extends around a portion of the circumference of outer surface 410.

Although the examples described herein, describe single digit numerals on outer edge, additional embodiments are not limited to single digit numerals and outer surface (described herein, for example 70, 170 and 410) can include multiple digit numerals or any combination thereof. Thus, a weightlifter can rotate weight plates on a barbell and achieve a plurality of different number combinations and indicia representations without being limited to the embodiment disclosed herein.

The features and aspects of the indicia described herein can be applied to any weightlifting device, free weights, weight plates or barbell devices using indicia application methods and devices, such as molding, imprinting, embossing or coloring methods or devices. In one embodiment, weight plates without indicia on its outer surface or a barbell without indicia (such as alignment indicia) on its outer surface are capable or accepting or receiving indicia thereon. In one example, an instrumentation device, such as a stencil which defines the outline of the indicia can be used to color or imprint indicia on the outer surface of a weight plate or barbell. In another embodiment, an instrumentation device can be any writing device, a heating element (such as a laser or other etching device) or a media applicator (such as sticker applicator, mixed media applicator, or 3D printer) can be used to mark the outer surfaces of the weight plate or barbell with indicia.

Further, although weight plates and barbells were described herein, this embodiment is exemplary and the present invention can be incorporated into any type weights, such as free weights or any apparatus that allows for changing of weight plates without departing from the spirit and scope of this invention.

What is claimed is:

1. A weight training apparatus comprising:

a first weight member having a first side, a second side and an outer surface having a width extending between the first and second sides, the first weight member having a known weight, and at least one first indicia disposed on the width of the outer surface of the first weight member, wherein the at least one first indicia does not indicate the known weight of the first weight member; and at least one second weight member having a first side, a second side and an outer surface having a width extending between the first and second sides, the at least one second weight member having a known weight, and at least one second indicia disposed on the width of the outer surface of the at least one second weight member, wherein the at least one second indicia does not indicate the known weight of the at least one second weight member, further wherein the first weight member and the at least one second weight member are configured to be rotated about an elongate member until the at least one first indicia and the at least one second indicia are aligned together such that the at least one first indicia and the at least one second indicia form a combined indicia equal to the total weight of the first weight member and the at least one second weight member.

2. The weight training apparatus of claim 1, wherein the elongate member has an outer surface with at least one alignment indicia for aligning with the at least one first indicia and the at least one second indicia.

3. The weight training apparatus of claim 1, wherein the at least one first indicia or the at least one second indicia is at least one of a marking, a language, a number, a symbol, and a letter.

4. The weight training apparatus of claim 1, wherein the at least one first indicia or the at least one second indicia are arranged in any order, sequence, series, color or pattern on the respective outer surface of the first weight member or the at least one second weight member.

5. The weight training apparatus of claim 1, wherein the at least one first indicia or the at least one second indicia is disposed around a circumference of the respective outer surface of the first weight member or the at least one second weight member.

6. The weight training apparatus of claim 1, wherein the at least one first indicia or the at least one second indicia is disposed around only a portion of the respective outer surface of the first weight member or the at least one second weight member.

7. The weight training apparatus of claim 1, wherein the at least one first indicia comprises a plurality of first indicia and the at least one second indicia comprises a plurality of second indicia, wherein the plurality of first indicia or the plurality of second indicia are equally spaced apart from each other around the respective outer surface of the first weight member or the at least one second weight member.

8. The weight training apparatus of claim 1, wherein the at least one first indicia or the at least one second indicia are separated from each other by alignment indicia on the respective outer surface of the first weight member or the at least one second weight member.

* * * * *